US005357734A

United States Patent [19]

Focke et al.

[11] Patent Number: 5,357,734

[45] Date of Patent: Oct. 25, 1994

[54] APPARATUS FOR PRODUCING PACKAGE COMPOSED OF PART PACKS

[75] Inventors: Heinz Focke, Verden; Hans-Jürgen Bretthauer, Bremen, both of Fed. Rep. of Germany

[73] Assignee: Focke & Co. (GmbH & Co.), Verden, Fed. Rep. of Germany

[21] Appl. No.: 4,292

[22] Filed: Jan. 14, 1993

[30] Foreign Application Priority Data

Jan. 16, 1992 [DE] Fed. Rep. of Germany ..... 4200921

[51] Int. Cl.[5] ..... B65B 47/04; B65B 11/28

[52] U.S. Cl. ..... 53/579; 53/234

[58] Field of Search ..... 53/207, 225, 234, 247, 53/171, 381.2, 539, 574, 578, 579

[56] References Cited

U.S. PATENT DOCUMENTS

| | | | |
|---|---|---|---|
| 1,161,455 | 11/1915 | Craggs | 53/579 X |
| 2,443,952 | 6/1948 | Gilbert | 53/234 |
| 2,949,713 | 8/1960 | Vogt | 53/579 X |
| 3,040,491 | 6/1962 | Viitanen | 53/247 X |
| 3,226,010 | 12/1965 | Rogers, Jr. . | |
| 3,253,387 | 5/1966 | Schmermund | 53/234 |
| 3,645,069 | 2/1972 | Waite | 53/247 X |
| 3,677,458 | 7/1972 | Gosling . | |
| 4,909,020 | 3/1990 | Focke | 53/234 X |
| 4,932,534 | 6/1990 | Focke et al. . | |

FOREIGN PATENT DOCUMENTS

| | | | |
|---|---|---|---|
| 344466 | 12/1989 | European Pat. Off. . | |
| 2355310 | 8/1974 | Fed. Rep. of Germany . | |
| 3313462 | 10/1984 | Fed. Rep. of Germany . | |
| 3433428 | 3/1986 | Fed. Rep. of Germany . | |
| 3818285 | 12/1989 | Fed. Rep. of Germany . | |
| 1085585 | 2/1955 | France | 53/578 |
| 148640 | 7/1931 | Switzerland . | |

*Primary Examiner*—Linda B. Johnson

*Attorney, Agent, or Firm*—Sughrue, Mion, Zinn, Macpeak & Seas

[57] ABSTRACT

Packages consisting of two part packs are in increasing demand as so-called cigarette sticks, because consumers want "half sticks", that is to say part packs having a smaller number of cigarette packs. The part packs are produced from a common one-piece blank which is severed before the package is put on sale, so that part packs formed from two part blanks are obtained. These are connected to one another by means of severable connecting members, especially adhesive strips. The mechanical high-performance production of such packages composed of two part packs is carried out in a folding turret. A one-piece blank is introduced into pockets of the folding turret and almost ready-folded. The groups of cigarette packs are then pushed via open sides into the part packs within the pockets.

17 Claims, 10 Drawing Sheets

APPARATUS FOR PRODUCING PACKAGE COMPOSED OF PART PACKS

BACKGROUND OF THE INVENTION

The invention relates to packages composed of at least two cuboid or cubic part packs, preferably each for receiving a group of cigarette packs, the part packs lying against one another with inner walls and being connected to one another. The invention relates, furthermore, to a process for producing such packages and to an apparatus.

Packs of the abovementioned type serve for receiving groups of cigarette packs and are often referred to in practice as cigarette sticks. The package can be divided in such a way that the two part packs form respective independent units having a group of, for example, five cigarette packs.

Examples of this type of a bundle pack for cigarettes are described in U.S. Pat. No. 4,932,534. In this known solution, the part packs are connected to one another in the region of a separating edge having perforations. When the package is put to use, the perforation of the separating edge is severed by breaking the part packs.

In another known version of this type of package, the part packs are connected to one another not only along a perforation line to be severed by breaking, but additionally by glue spots which are made in the region of the mutually confronting inner walls of the part packs. Furthermore, the part packs are connected to one another by means of a perforated adhesive strip extending in the region of longitudinal side walls and of end walls. The perforation of the adhesive strip also has to be eliminated in order to separate the part packs.

The abovementioned packages do not yet have the best possible design from a point of view of production and handling. Moreover, the solutions in terms of the apparatus for producing the packs which emerge from U.S. Pat. No. 4,932,534 have not proved efficient.

SUMMARY OF THE INVENTION

The object on which the invention is based is to improve the design of the type of package described in the introduction and, furthermore, to propose a process and an apparatus for efficient industrial production.

To achieve this object, the package according to the invention is characterised in that (both) part packs are formed from a common one-piece or one-part blank and the latter is severed, during the joint production of the part packs or thereafter, into two part blanks corresponding to the part packs.

A particular feature of the package according to the invention is, therefore, that the two part packs are produced from a common one-piece blank, but this is severed mechanically during the production process or immediately thereafter, so that two separate part packs are obtained. These are detachably connected to one another in a suitable way. This measure, namely the use of a one-piece blank for two (part)packs, markedly increases the production efficiency, since, with each machine cycle, two part packs and therefore a complete "double stick", having two groups of cigarette packs are produced.

The mechanical severing of the connection between the part packs in the region of an edge connection of the inner walls can be carried out in various ways. In one solution according to the invention, the inner walls of the not yet filled packages bear against a folding member which at the same time serves with the outer edge as severing knife. By pushing in the groups of cigarette packs, the edge connection is pressed against a severing knife edge. The package is thereby divided into the two part packs.

In an alternative, after the completion of the package, the edge connection is severed by a knife which penetrates between the two part packs and which is moved in the longitudinal direction of the package.

The apparatus according to the invention is equipped with a folding turret, the pockets of which are each designed to receive a package. According to the invention, first the one-piece blank is introduced into the pocket and thereby prefolded insofar as part packs remain open on the radially outer side of the pockets or of the folding turret. In the region of a filling station, the two groups of (small) packs are pushed simultaneously into the part packs. The package is or the part packs are thereafter ready-folded.

The pockets with the folding members for the blank are designed in a special way. Likewise, measures according to the invention are provided in the region of the filling station, these guaranteeing an orderly positioning of the superposed groups of (cigarette)packs.

An exemplary embodiment of the package as well as exemplary embodiments of the apparatus for producing it and the process cycle are explained in more detail below by means of the drawings. In these:

DESCRIPTION OF PREFERRED EMBODIMENTS

Figure 1:
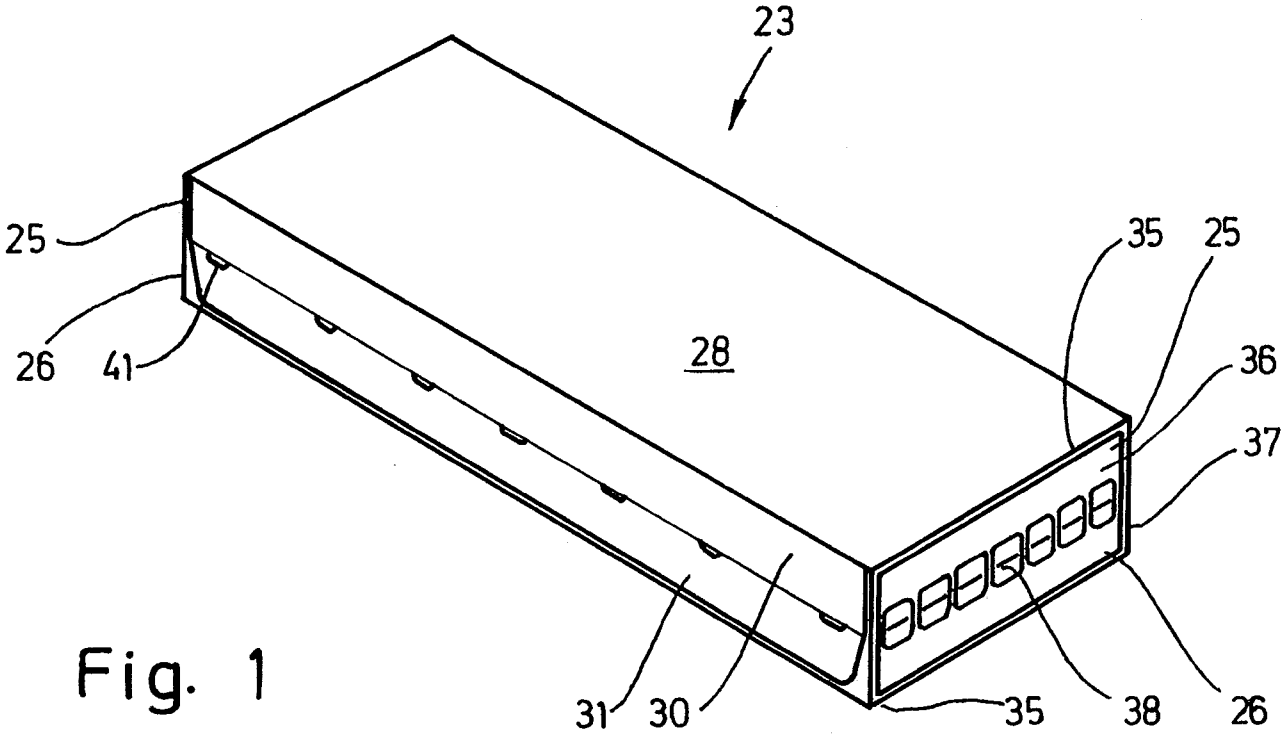
FIG. 1 shows the perspective view of a package consisting of two part packs.
Figure 2:
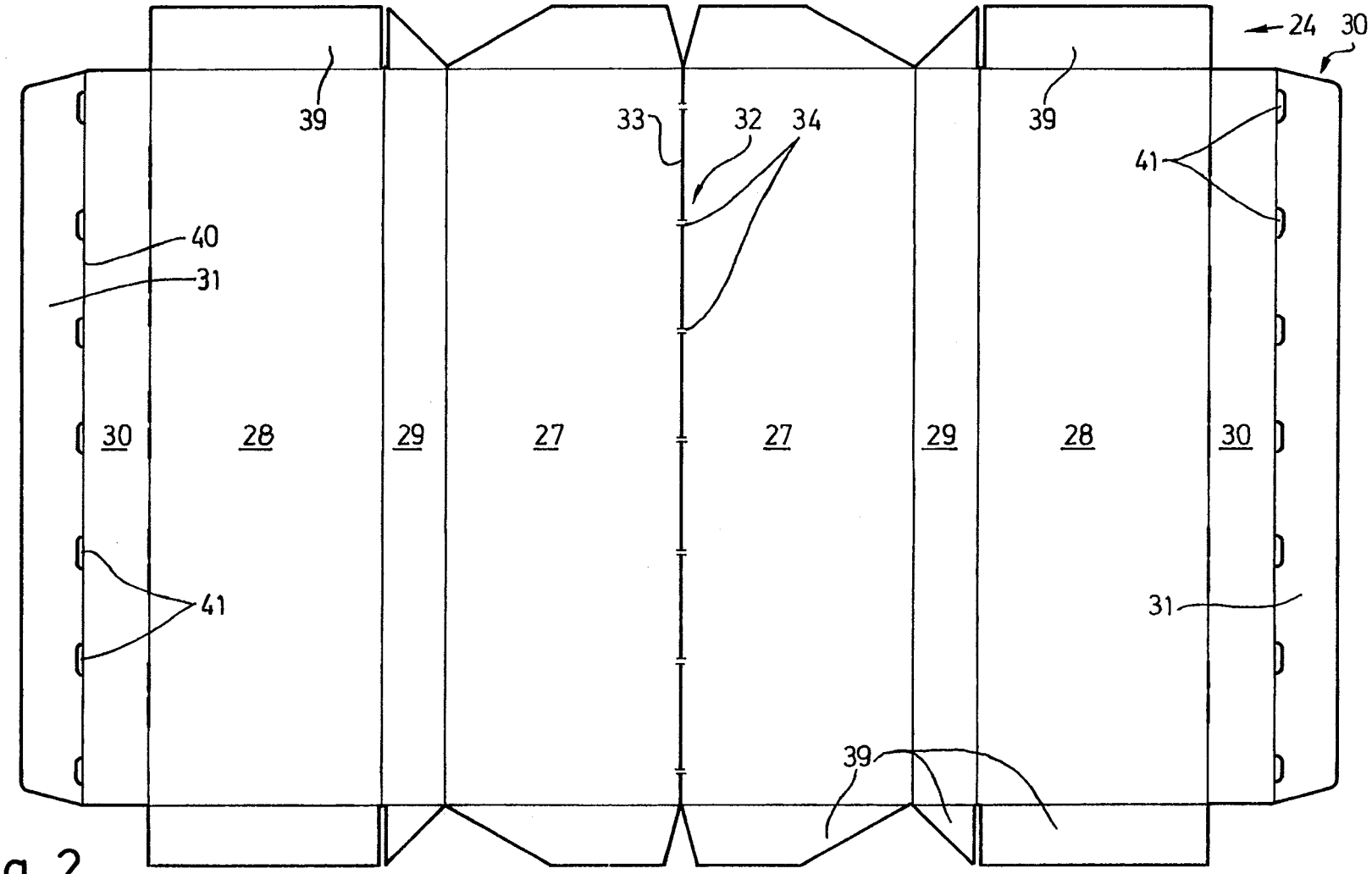
FIG. 2 shows a blank for a package according to FIG. 1 in the spread-out position.

The exemplary embodiments in the drawings concern large packs for a multiplicity of cuboid small packs, namely cigarette packs 20. Two groups 21, 22 of these cigarette packs 20 are accommodated in a (large)package 23, also called a cigarette stick. The package 23 consists of an originally one-piece blank 24 made of thin cardboard or of another suitable packaging material.

The package 23 formed from it consists of two part packs 25, 26, each for receiving a group 21, 22 of cigarette packs 20.

Figure 7:
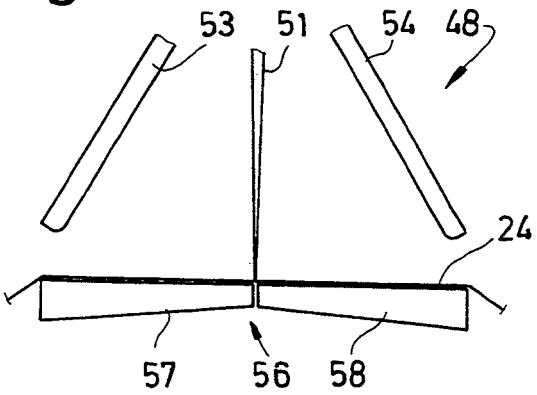
Figure 10:
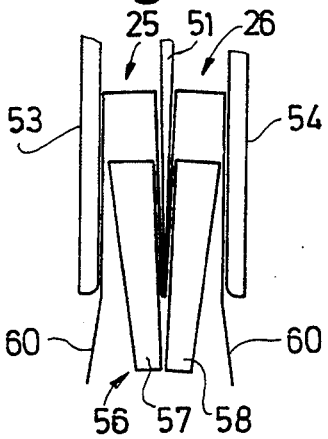

The blank 24 is so designed that two part packs 25, 26 completely enveloping the pack contents are formed, each with an inner wall 27, an opposite outer wall 28, a first closed longitudinal side wall 29 and a second longitudinal side wall 30. The latter is equipped at the free edge with an insert tab 31 which, with the part pack 25, 26 closed, is slipped or pushed into a position between the inner wall 27 and the pack contents, in a manner corresponding to the arrangement according to FIG. 7 in U.S. Pat. No. 4,932,534.

Figure 4:
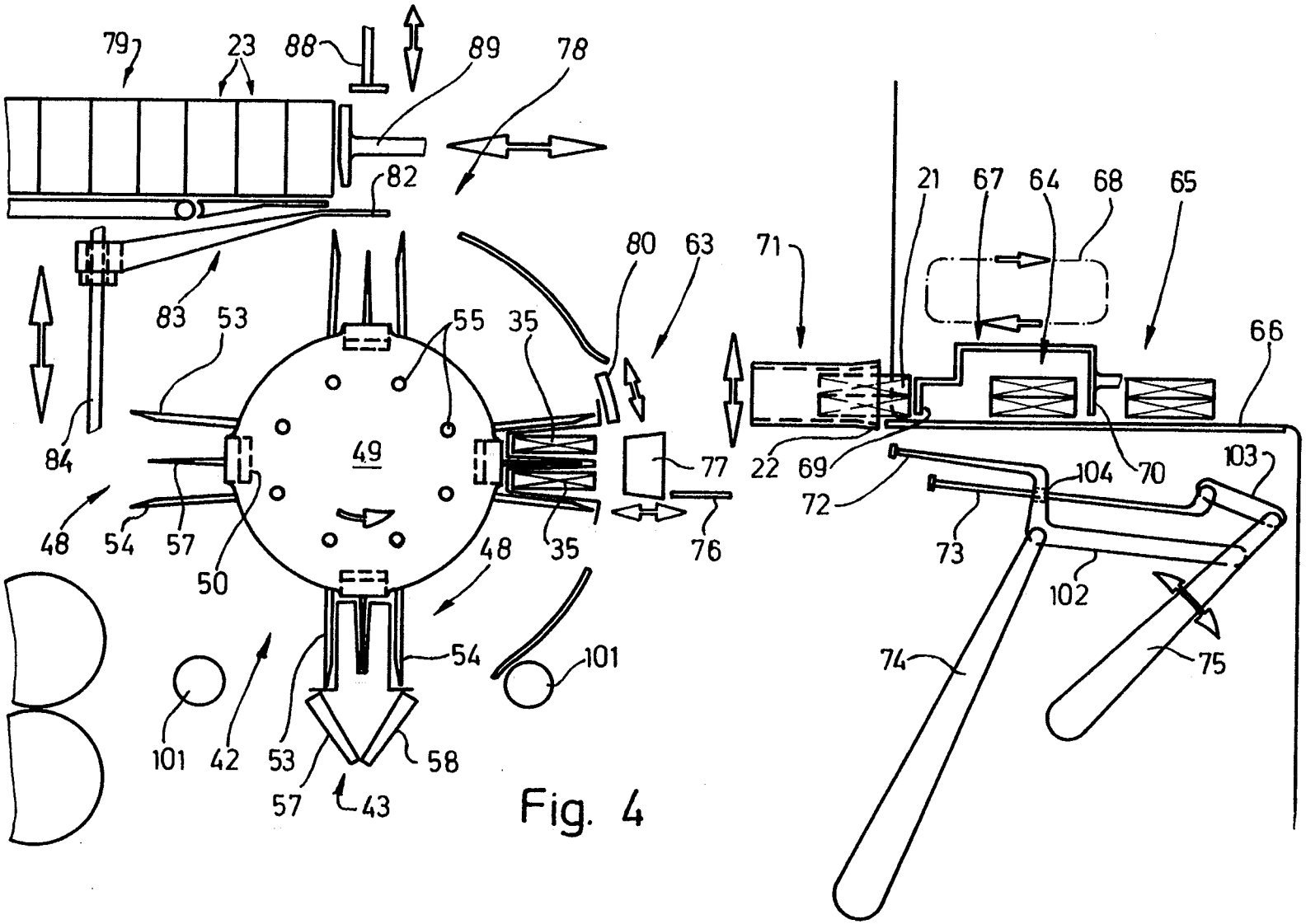
FIG. 4 shows a cutout from the apparatus according to FIG. 3 on an enlarged scale.

In the present instance, the blank 24 or package 23 is so designed that the handling principle which can be taken from U.S. Pat. No. 4,932,534 can be put into practice. This means that the package 23 is equipped with a temporary closure at the factory, that is to say in the cigarette factory. Thus, the side wall 30 with insert tab 31 of one part pack 25 covers the corresponding blank parts of the other part pack 26, according to FIG. 4 of U.S. Pat. No. 4,932,534. After revenue marks or revenue stamps have been affixed, the insert tab 31 is folded into the position described.

The identically designed halves of the blank 24, each for forming a part pack 25, 26, are joined together in the region of mutually confronting edges of the inner wall 27 by means of an edge connection 32, to form a unit, that is to say a one-piece blank 24. In the present instance, the edge connection 32 consists of long punched cuts 33 and of a few short residual connections 34 of the packaging material. In the exemplary embodiment shown here, the edge connection 32 is severed during the production of the package 23 or immediately thereafter, so that two independent part packs 25, 26 connected detachably to one another are obtained. In the present, particular exemplary embodiment, adhesive strips 36 are affixed in the region of mutually opposite end walls 35 and connect the two part packs 25, 26 to one another. So that these can be separated from one another for any individual sale, adhesive strips 36 are provided with large-area recesses 37 which act as a perforation. Between the rectangular or square recesses 37 are located very thin material webs 38 which can easily be torn off. The shape of this perforation, namely the size of the recesses 37, guarantees a reliable severing of the adhesive strip 36 in the plane between the part packs 25, 26, specifically even when the adhesive strip 36 is not centred exactly in the region of the end walls 35 as a result of production tolerances.

The end walls 35 on both sides of the package 23 or of the part packs 25, 26 consist of specially designed end flaps 39. These are folded with a partial overlap and glueing.

A further special feature is the design of the insert tabs 31. In the region of a folding edge 40 between the insert tab 31 and adjacent longitudinal side wall 30 are located short tongues 41 formed by punchings. These tongues 41 are connected to the longitudinal side walls 30 in the region of the folding edge 40. When the insert tab 31 is being folded into the region between the inner wall 27 and the pack contents, the tongues 41 remain in the plane of the longitudinal side wall 30. Since the tongues 41 are located in the region of residual connections 34 of the edge connection 32, projections or serrations of the residual connections 34, formed as a result of the severing operation in the region of the edge connection 32, are covered by the tongues 41.

Figure 3:
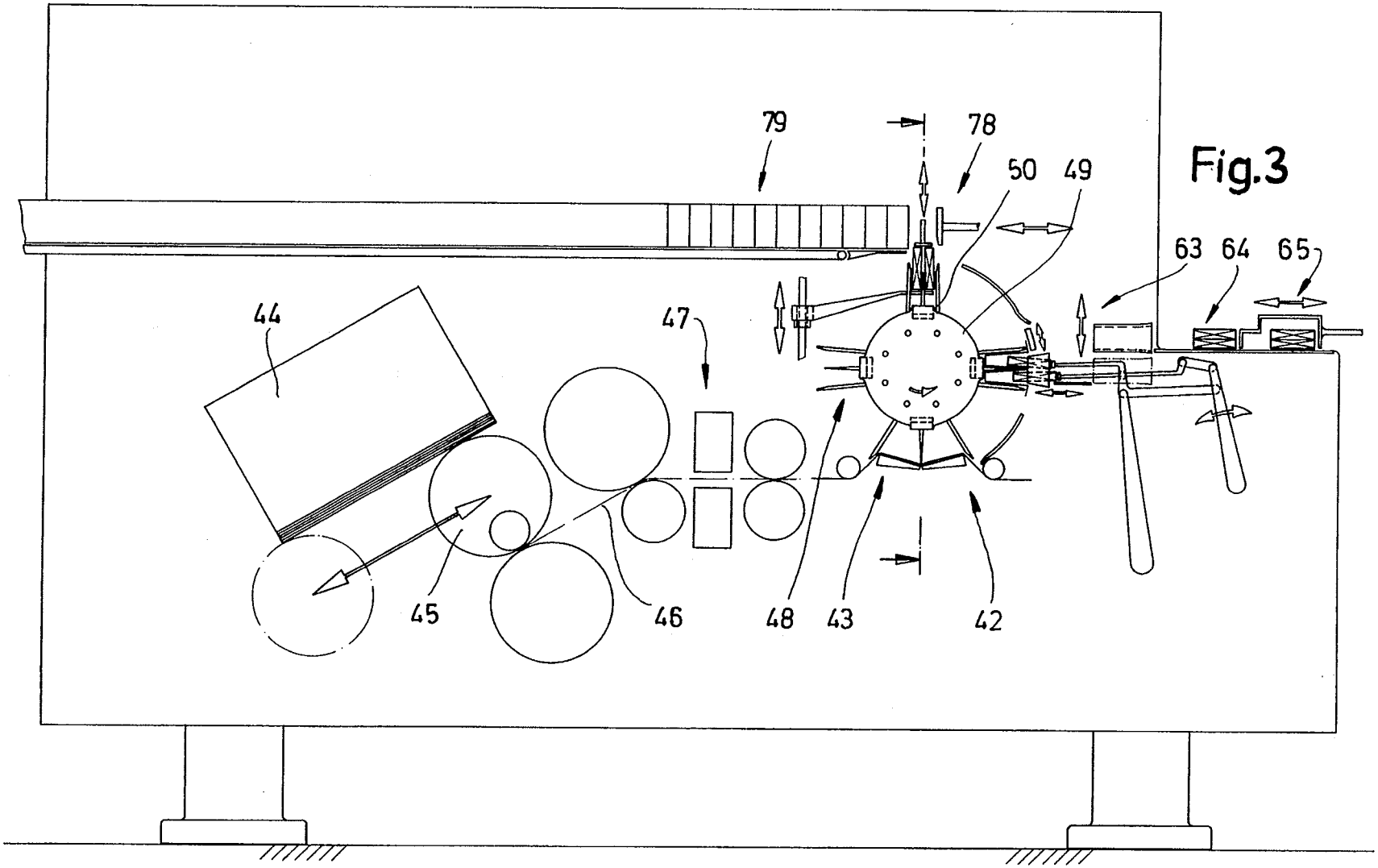
FIG. 3 shows a simplified side view of an apparatus for producing a package according to FIG. 1.

Packages 23 designed in a way described or in a similar way are produced in a high-performance packaging machine, as illustrated in FIG. 3 ff. The principal part of this packaging machine is a folding turret 42 driven in rotation in a vertical plane. The plane, non-folded blanks 24 are fed to the latter in the region of a feed station 43. The blanks 24 are extracted from a blank magazine 44, here by a roll-off device 45 known in the art. In the region of a following blank track 46, the blanks 24 are transported by advancing rollers. At the same time, the blanks 24 also run through a glue-coated unit 47 for applying glue spots to folding flaps.

The folding turret 42 is equipped with special pockets 48. These are directed radially or are open on the radially outer side for pushing in and pushing out a blank 24 and package 23. Four pockets 48 arranged at equal distances from one another are provided. The particular pocket 48 directed downwards is located in the feed station 43.

The folding turret 42 consists of two turret discs 49 which are arranged at a distance from one another and which are connected to one another in the region of the pockets 48 by means of crossmembers 50. The crossmembers 50 at the same time form a bottom of the pockets 48.

Each pocket 48 consists of a centrally arranged and radially directed folding blade 51. The folding blade 51 is made thin-walled and so as to taper outwards to a point or to a sharp edge. As is evident from FIGS. 18 and 19, the folding blade 51 is made comb-like with a plurality of comb fingers 52 arranged at a distance from one another. The folding blade 51 is connected firmly to the folding turret 42, namely to the associated crossmember 50.

Pocket walls 53, 54 serve for the lateral limitation of the pockets 48. These pocket walls are respectively mounted pivotably with ends or edges confronting the turret discs 49, specifically between the turret discs 49. Pivot bearings 55 for each pocket wall 53, 54 are respectively formed at a distance from the edge of these. The pocket walls 53, 54 can thus be moved between an open or spread position (bottom of FIG. 5) and an approximately parallel position (top of FIG. 5). The pocket walls 53, 54 are mounted at equal distances on both sides of the folding blade 51.

The blank 24 is introduced in the region of the feed station 43 into a downwardly directed pocket 48 and is largely folded in the latter to form the package 23, in such a way that the part packs 25, 26 are open only on the radially outer side, namely in the region of the longitudinal side wall 30. The corresponding folding operations take place during the temporary standstill of the folding turret 42 in the feed station 43.

For this purpose, the feed station 43 is assigned a folding unit 56 which is mounted so as to be movable up and down in the radial direction relative to the folding turret 42, but in an otherwise stationary manner. The folding unit 56 is described further below in connection with FIG. 16 and FIG. 17.

Folding tools of the folding unit 56 are two folding wings 57, 58 which are pivotable jointly and in opposite directions about a common axis aligned centrally with the pocket 48 or the folding blade 51.

The folding steps executed by the folding unit 56 can be seen from FIG. 6 to FIG. 11. In a lower position, the folding wings 57, 58 are extended and therefore form a common plane. The folding wings 57, 58 are located in the feed plane for the blanks 24. A blank 24 is deposited centrally, that is to say in alignment with the pocket 48, on the folding wings 57, 58.

Next (FIG. 7), the folding unit 56 or the folding wings 57, 58 are raised, thereby taking up the blank 24, until the blank 24 comes to bear against the free edge of the folding blade 51. The latter extends in the region of the edge connection 32, that is to say between the blank halves.

Figure 8:
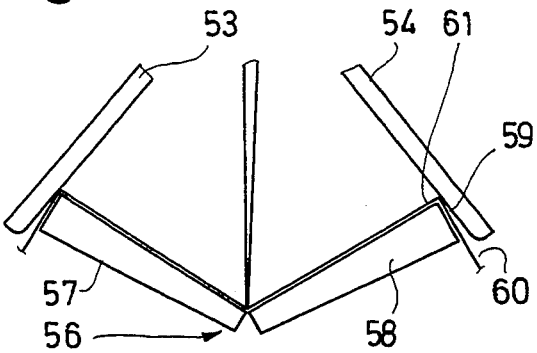

The folding wings 57, 58 are then pivoted towards one another, without the height position being varied. The blank 24 is thereby folded round the folding blade 51. The dimensions of the pocket 48, namely the distances between the spread pocket walls 53, 54, are calculated so that a free, lateral folding edge 59 of the folding wings 57, 58 slides respectively along on the inside of the pocket walls 53, 54. The blank 24 is thereby folded round in the region of the folding edge 59 to form a first folding leg 60. The folding edge 59 is equipped with a right-angled folding cant 61 which takes effect in the region of a folding line between the inner wall 27 and the longitudinal side wall 29 and which executes a right-angled fold (FIG. 8).

Figure 9:
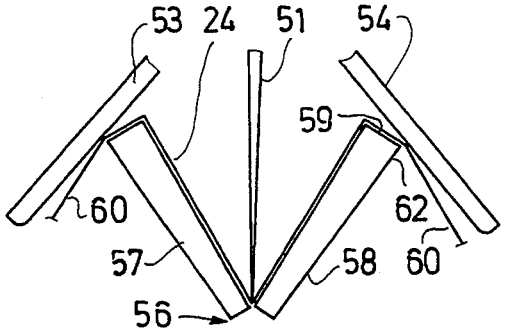

In the course of the further pivoting movement of the folding wings 57, 58 in the direction of the folding blade 51, a further folding cant 62 of the folding wings 57, 58 comes into effect. By bearing against the pocket wall 53, 54, a further fold is executed, namely a folding line between the longitudinal side wall 29 and the outer wall 28. The folding edge 59 therefore has a width which corresponds to that of the longitudinal side wall 29 (FIG. 9).

The above-described movements of the pocket walls 53, 54, on the one hand, and of the folding wings 57, 58, on the other hand, take place in a controlled manner continuously and in coordination with one another.

Figure 11:
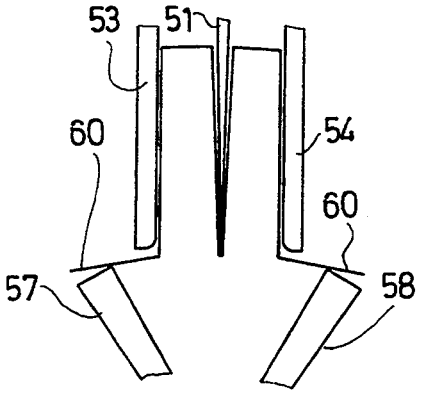

The folding wings 57, 58 are further pivoted, together with the blank 24, until they bear against the folding blade 51. The pocket walls 53, 54 are thereafter pivoted towards one another until they bear against the folding wings 57, 58. The laterally open part packs 25, 26 are thereby put into shape. The folding wings 57, 58 are now moved out of the pocket 48 as a result of a downward movement of the folding unit 56 (FIG. 10), and when they leave the pocket 48, the folding wings 57, 58, are pivoted with a spreading effect. The folding legs 60 of the blank 24 which project from the pocket 48 are thereby folded outwards (FIG. 11). These are longitudinal side walls 30 with insert tab 31.

Figure 6:
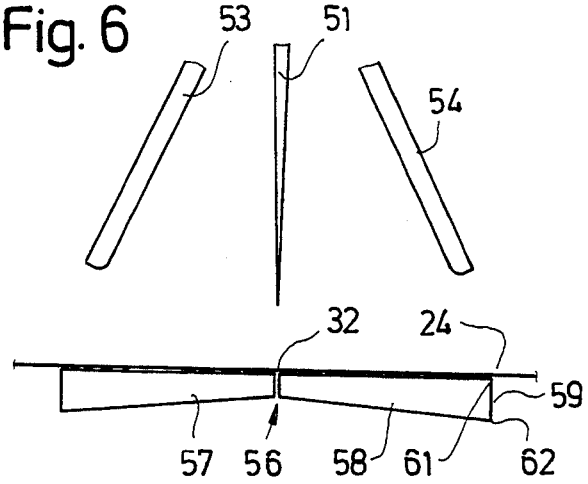

Located above the feed plane according to FIG. 6, on both sides of the pocket 48, are stop members, namely stationary deflecting rods 101. These ensure a correct guidance and support of the blanks 24 during introduction into the pocket 48.

After the substantial folding of the blank 24 in the feed station 43, the folding turret 42 is switched one stroke further by rotation, so that the pocket 48 together with the package 23 prefolded according to FIG. 11 comes into a filling station 63. In this, the pockets 48 are each directed horizontally, so that cigarette packs 20 can be introduced into the open package 23 in a horizontal pushing-in movement.

The cigarette packs 20 are fed to the folding turret 42 in an axis-parallel direction in the region of the filling station 63. The cigarette packs 20 come from a packaging machine which, in the present instance, has two-track production. Consequently, two parallel rows 64 and 65 of two respective superposed cigarette packs 20 arrive. The rows 64, 65 are conveyed intermittently on a platform 66.

A specially designed slide 67, by moving transversely to the rows 64, 65, takes off from the rows 64, 65 respective units composed of two superposed groups 21, 22 of cigarette packs 20. The slide 67 is moved in a special way. The pushing-off movement of the cigarette packs 20 takes place in the plane of the platform 66. To return to the initial position, the slide 67 is guided above the cigarette packs 20 along the path of movement 68 represented by dot-and-dash lines.

The slide 67 is designed as a double slide with two slide walls 69 and 70. The slide wall 69 located at the front in the direction of movement serves for pushing off cigarette packs 20 from the row 64. The rear slide wall 70 pushes off a respective unit from the row 65. In particular, the transport of the cigarette packs 20 and the formation of the groups 21, 22 take place in that, in a first work cycle of the slide 67, groups 21, 22 of the row 64 on the platform 66 are displaced into an intermediate conveyor 71. At the same time, a corresponding unit composed of groups 21, 22 from the row 65 is displaced by the rear slide wall 70 into the region of the row 64 and deposited there. The subsequent cigarette packs 20 of the rows 64, 65 are stopped during this pushing-off operation, so that no further cigarette packs 20 are conveyed during this phase. In the next work cycle of the slide 67, the unit previously deposited in the region of the row 64 is transported to the intermediate conveyor 71. Only thereafter are the stops for the rows 64, 65 cancelled and further cigarettes conveyed.

In the present instance, the intermediate conveyor 71 is a stage which is of closed cross-section and is open on two opposite sides and which is movable up and down according to the double arrow. In the present instance, the platform 66 is located at a level higher than or offset relative to the push-in plane of the pocket 48 in the filling station 63. The groups 21, 22 are therefore lowered to the push-in plane by the intermediate conveyor 71. Conveying members push the cigarette packs 20 out of the intermediate conveyor 71 and into the pocket 48 or into the prefolded part packs 25, 26.

Here, these conveying members are elongate rams 72, 73. These take effect in vertically offset planes. The upper ram 72 acts on the upper pack group 21 and the lower ram 73 on the lower pack group 72.

The rams 72, 73 are driven by two actuating arms 74, 75 moving to and fro in a pivoting movement. The longer actuating arm 74 is connected to the upper ram 72. This is cranked and forms a leg 102 underneath the lower ram 73. The free end of the ram 72, namely the cranked leg 102, is also connected to the second actuating arm 75. The free end of the lower ram 73 is connected via a link 103 to the upper or free end of the actuating arm 75. The lower ram 73 is guided through a bore 104 in the ram 72, namely in the region of the cranking of the latter.

Figure 5:
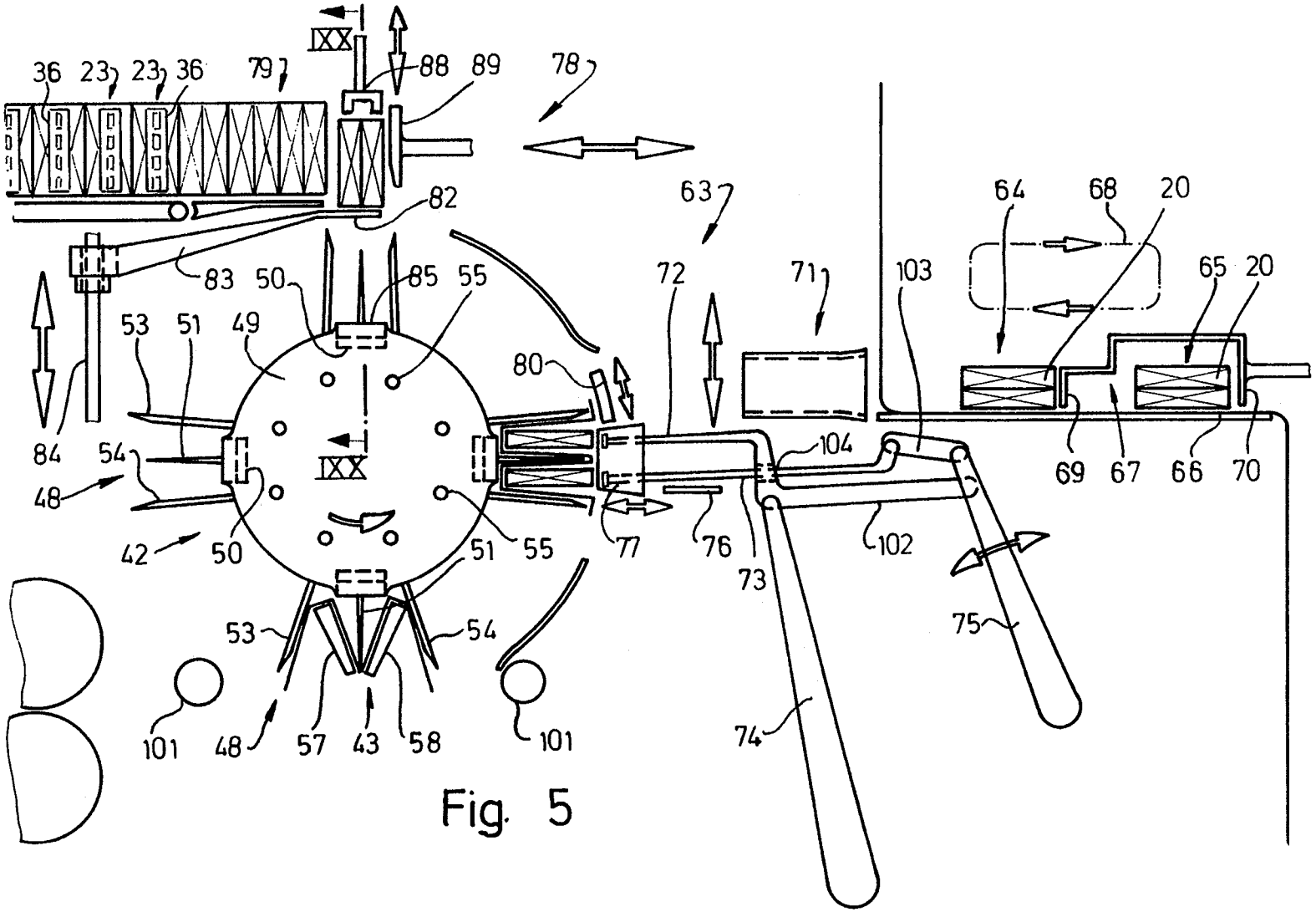
FIG. 5 shows a representation according to FIG. 4 in a changed position and with a modification of the exemplary embodiment according to FIG. 4, FIG. 6 to FIG. 11 show side views of successive folding positions during the folding of the blank according to FIG. 2 in the region of a folding turret.

In its lower position, the intermediate conveyor 71 is at a distance from the pocket 48. This is spanned by a bridge 76, a flat section, extending in the push-in plane. Adjacent to this bridge 76 is a mouthpiece 77 which is likewise movable to and fro in the radial direction, that is to say can be advanced to the pocket 48. The two groups 21, 22 are pushed through this mouthpiece (FIG. 5).

Figure 12:
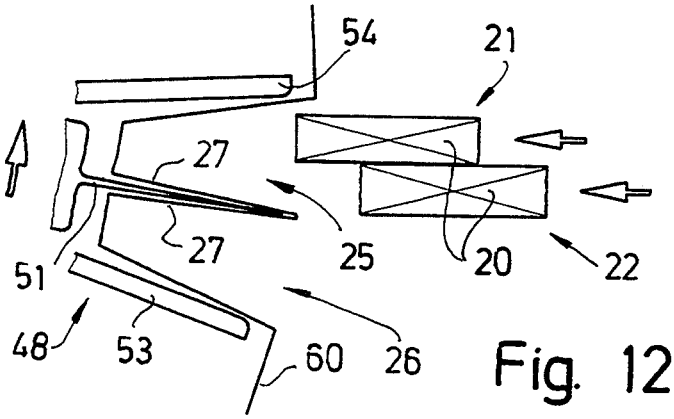
FIG. 12 to FIG. 15 show side views of different positions during the introduction of articles (cigarette packs) into the partially folded package.
Figure 13:
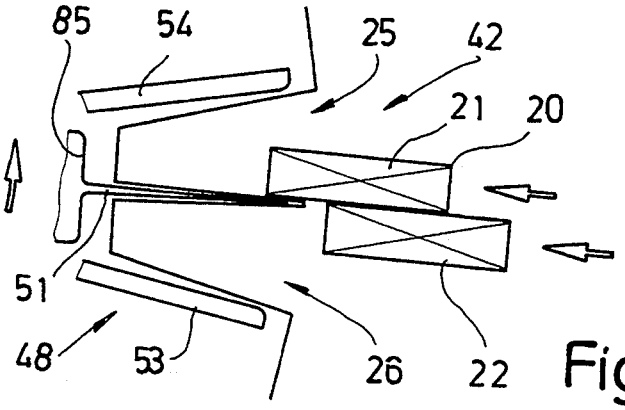
Figure 14:
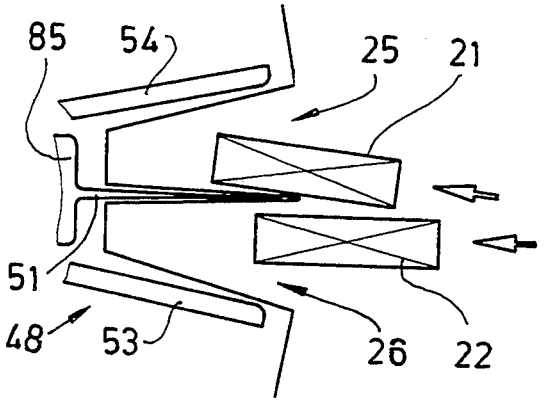
Figure 15:
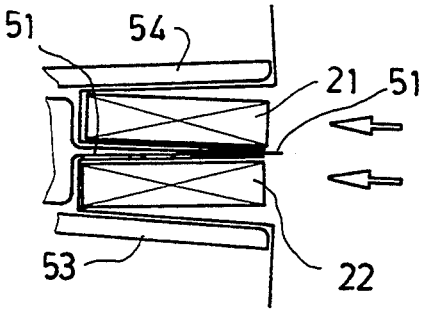

The pushing of the groups 21, 22 into the pocket 48 or into the part packs 25, 26 is a special movement cycle which is illustrated in the individual phases in FIG. 12 to FIG. 15. According to these, the superposed groups 21, 22 are fed to the folding turret 42 in an offset position as a result of a corresponding relative position or relative movement of the rams 72, 73. The upper group 21 is nearer the pocket 48. The movement of the cigarette packs 20 is synchronised with the rotational movement of the folding turret 42 in such a way that the upper group 21 already projects slightly into the pocket 48 or into the upper part pack 25 when, with the pocket walls 53, 54 spread, it approaches the filling station 63 (FIG. 12). The cigarette packs 20 of the upper group 21 thereby come into the path of movement of the folding blade 51. This is moved from below up against the cigarette packs 20 of the group 21 (FIG. 13). When the rotational movement of the folding turret 42 continues, the cigarette packs 20 of the upper group 21 are lifted off somewhat from the lower group 22 (FIG. 14). The radial pushing-in movement is continued in the meantime, so that the cigarette packs 20 of the lower group 22 enter the part pack 26 which now comes into the region of the push-in plane. The radial pushing-in movement can now be continued. When the pocket 48 has reached the filling station 63 completely and the folding turret 42 is stopped, the pushing in is completed (FIG. 15). The pocket walls 53, 54 are now moved into the parallel position. The filling operation is thus concluded.

The next movement cycle of the folding turret 42 conveys the now filled package 23 into a push-out station 78. This is located on the top side of the folding turret 42. As a result of an upwardly directed movement, the finished package 23 is pushed out of the pocket 48 and transferred to a discharge conveyor track 79 above the folding turret 48.

After the filling operation in the filling station 63 has terminated, the folding legs 60 directed sideways or pointing in the circumferential direction of the folding turret 42 are folded against the open side of the package 23 according to the representation in FIG. 1. For this purpose, a folding member 80 movable to and fro in the circumferential direction of the folding turret 42 is provided in the region of the filling station 63. This folding member successively folds the folding legs 60, that is to say the longitudinal side walls 30 with insert tab 31.

To carry out the pushing of the packages 23 out of the pockets 48 in the radial direction, the folding turret 42 is designed in a special way. The folding blade 51 is made comb-like in the same way as the pocket walls 53, 54. The folding blade 51 consists of comb fingers 52 arranged at a distance from one another. The pocket walls 53, 54 correspondingly consist of pocket webs 81 extending in identical circumferential planes. Between the comb fingers 52 of the folding blade 51 and the pocket webs 81 of the pocket walls 53, 54 extend respective pushing-out members, namely sliding fingers 82 of a pack lifter 83. The latter is arranged at a fixed location next to the folding turret 42 in the region of the push-out station 78. The pack lifter 83 is movable up and down on a vertical supporting rod 84 by an actuating member (not shown). The free end of the pack lifter 83, said free end being made comb-like by the sliding fingers 82, penetrates into the region of the pocket 48. After a package 23 has been pushed out (FIG. 5), the pack lifter 83 is moved back into the lower initial position. The sliding fingers 82 thereby come into a position in which, during the further movement of the folding turret 42, they assume the radially inner position (represented by dot-and-dash lines in FIG. 19). The pockets 48 are so designed that, in the initial position (represented by dot-and-dash lines in FIG. 19), the sliding fingers 82 are located above or on the radially outer side of the continuous crossmember 50. A pocket bottom 85 is offset outwards in the radial direction, so that, during the rotation of the folding turret 42, the sliding fingers 82 come into a position underneath the package 23 in the push-out station 78. The pocket bottom 85 is therefore formed only in the region of the comb fingers 52 of the folding blade 51.

The package 23, formed from an originally coherent blank 24, is divided into the two part packs 25, 26. For this purpose, the edge connection 32 is severed. In the present exemplary embodiment, the residual connections 34 are severed. Various possibilities for this are indicated.

Figure 18:
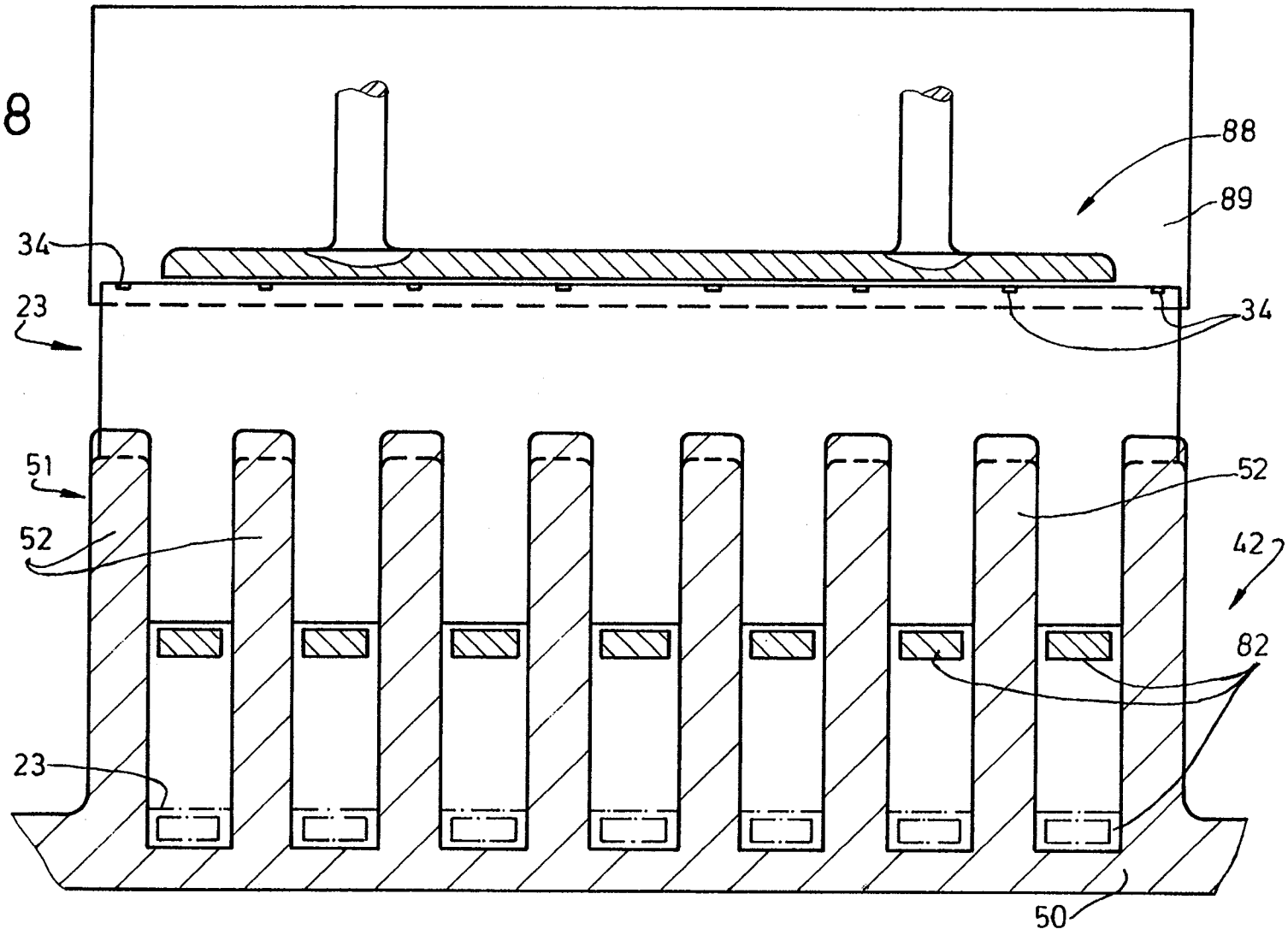
FIG. 18 shows a detail of the folding turret in the region of a push-out station on a greatly enlarged scale and partially in section.

In the example according to FIG. 12 to FIG. 15 and FIG. 18, the residual connections 34 are severed by the folding blade 51. This has dimensions larger in the radial direction than the inner walls 27 bearing against the folding blade 51. When the groups 21, 22 are being pushed into the part packs 25, 26 in the region of the filling station 63, pressure is exerted on the longitudinal side walls 29. This generates the necessary cutting pressure which leads to the severing of the residual connections 34 by the sharp-edged folding blade 51. In the actual example, the comb fingers 52 are designed at the free outer ends with knife-like edges. The residual connections 34 to be severed each extend in the region of a comb finger 52 acting in the same way as a knife. The part packs 25, 26 separated from one another are therefore already formed here in the filling station 63. FIG. 18 shows details in the region of the push-out station 78. The residual connections 34 are already severed. Only the serrated residues can still be seen.

Figure 19:
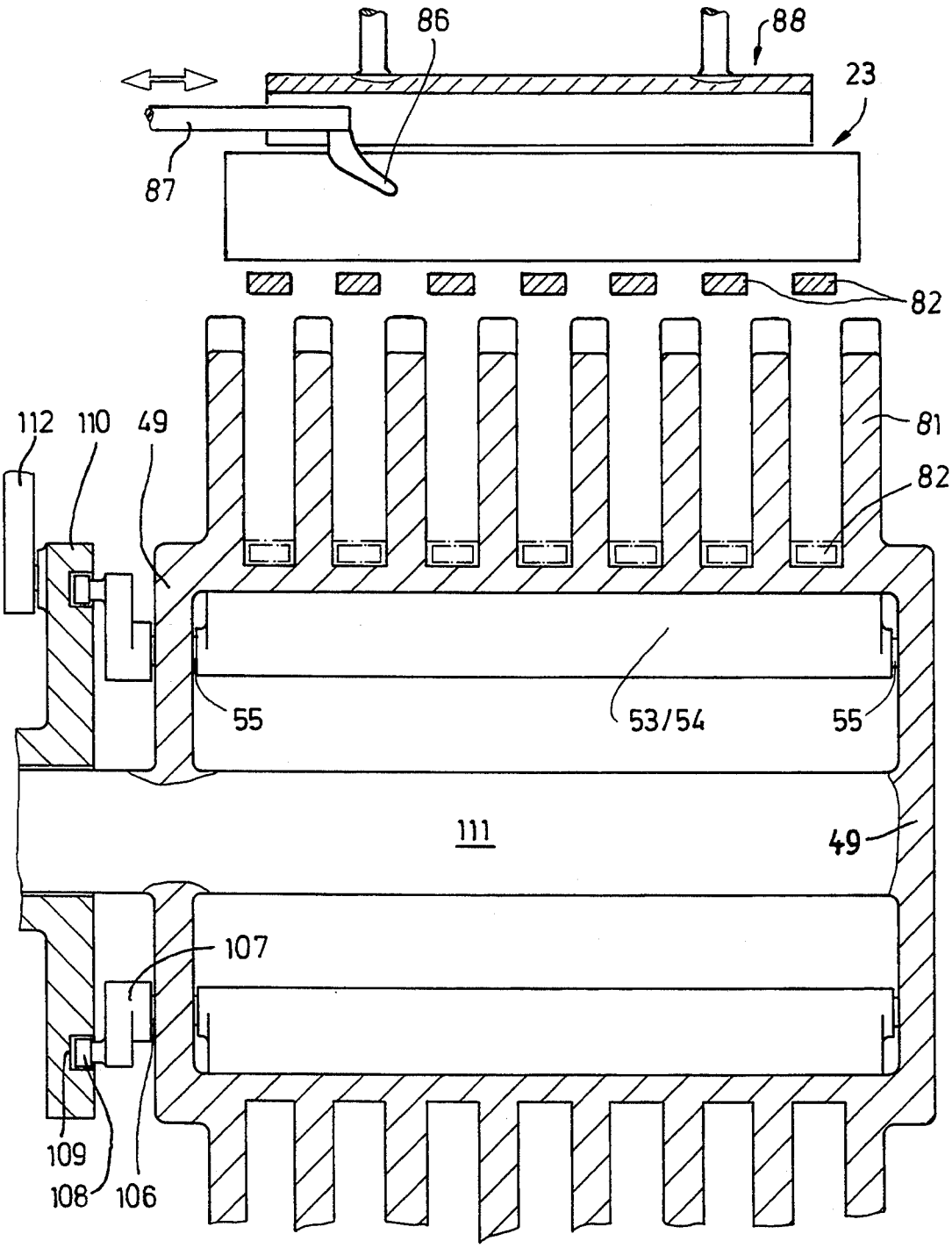
FIG. 19 shows the folding turret in vertical section with details in the region of a push-out station in the sectional plane IXX—IXX of FIG. 5.

In the version according to FIG. 5 and FIG. 19, the cohesion of the blank 24 is preserved as far as the push-out station 78. After the ready-folded package 23 has been pushed out or lifted out, the residual connections 34 are severed by a severing knife 86 which is guided in the longitudinal direction through the gap formed between the part packs 25, 26. For this purpose, the severing knife 86 is mounted on an actuating rod 87 which is movable to and fro. This cutting station also includes a stay 88 which is of U-shaped cross-section and which bears with its legs against the respective longitudinal side walls 30 of the part packs 25, 26. The cutting device thus far described comes under consideration for those packages 23 which are ready-folded before they reach this cutting station, that is to say those in which the insert tab 31 is already pushed into the end position between the inner wall 27 and the pack contents, so that the residual connections 34 are exposed for the severing cut.

The discharge conveyor track 79 is assigned a pushing-off device 89 which is movable to and fro in the direction of the latter. This pushes the finished packages 23 in succession onto the discharge conveyor track 79.

FIG. 19 also shows the pivot bearings 55 of the pocket walls 53, 54 in the turret discs 49. A pivot pin 106 connected to the pocket walls 53, 54 passes through the turret disc 49 and is connected to a crank piece 107. This penetrates with a tracer roller 108 into a control groove 109 of a control disc 110. The control disc 110 is mounted rotatably on a central turret shaft 111. To adjust the pocket walls 53, 54, the control disc 110 is rotated on the turret shaft 111, specifically by means of an actuating arm 112. Depending on the direction of movement of the pocket walls 53, 54, the control disc 110 is rotated in one direction or the other. Corresponding pivoting movements are transmitted to the pocket walls 53, 54 via the crank piece 107.

Figure 16:
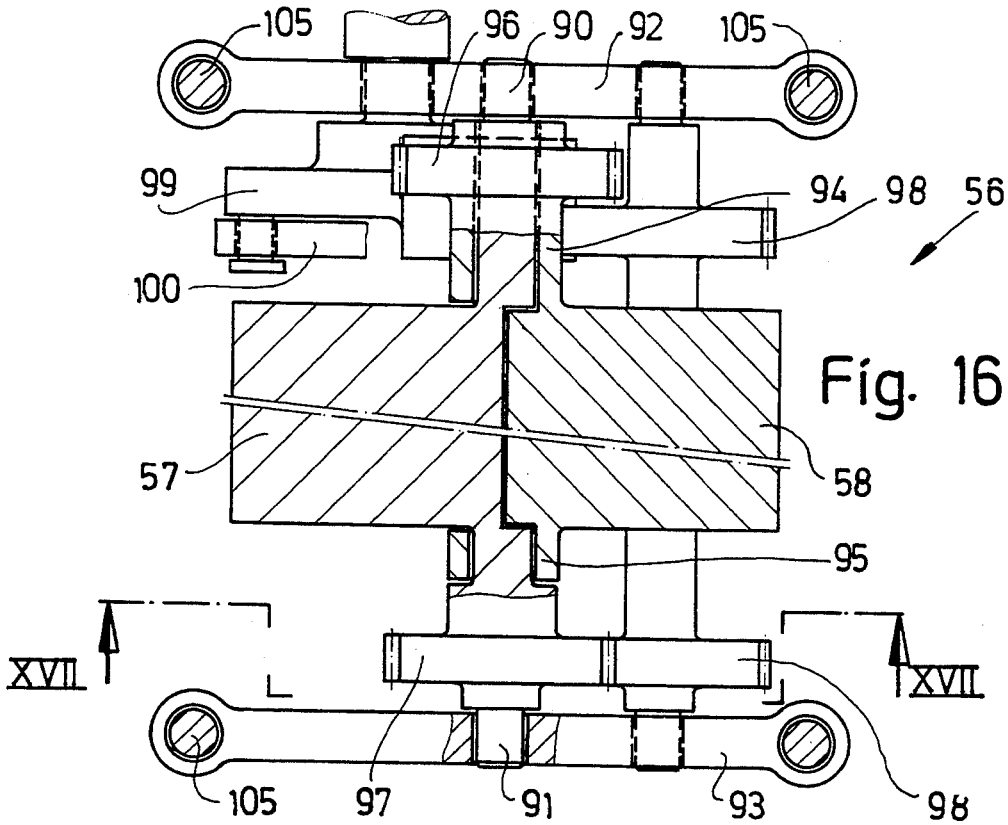
FIG. 16 shows a partially sectional top view of a detail of a pocket of a folding turret.
Figure 17:
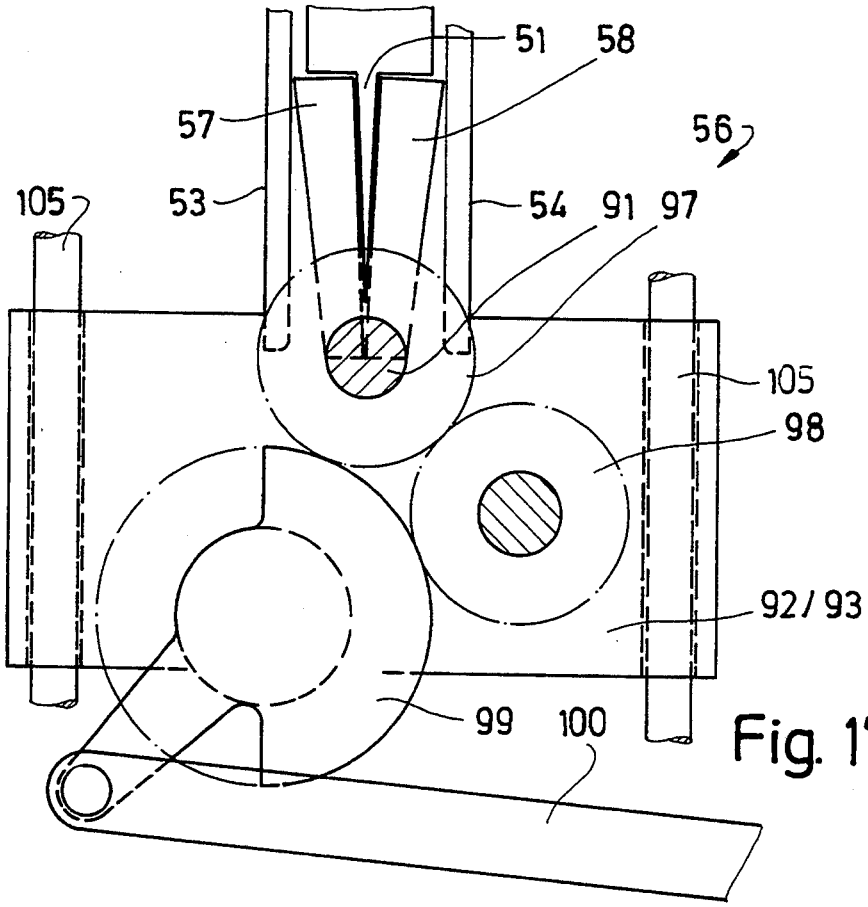
FIG. 17 shows the detail according to FIG. 16 in a section XVII—XVII.

The already mentioned folding unit 56 in the region of the feed station 43 is shown in detail in FIG. 16 and FIG. 17. According to these, the two folding wings 57, 58 are pivotable with the mutually confronting edges about a common axis. For this purpose, the folding wing 57 is respectively mounted rotatably in lateral supporting walls 92, 93 by means of an axle journal 90 and a coaxial shaft journal 91. The other pocket wall 54 is mounted rotatably on the axle journal 90 by means of a hollow shaft 94 and on the shaft journal 91 by means of a hollow journal 95. The hollow shaft 94 and the hollow journal 95 are therefore mounted coaxially relative to the axle journal 90 and to the shaft journal 91.

For the pivoting drive of the pocket walls 53, 54, driving wheels, namely gearwheels 96 and 97, are arranged on the hollow shaft 94, on the one hand, and on the shaft journal 91, on the other hand. These gearwheels 96, 97 are driven in the case of corresponding directions of rotation via intermediate wheels 98 by a driving member, in the present instance by a toothed quadrant 99 rotatable to and fro. This is itself moved by a connecting rod 100.

The folding unit 56 thus designed is movable up and down relative to the folding turret 42. For this purpose, the supporting walls 92, 93 are mounted displaceably on vertical supporting rods 105. The member for adjusting the folding unit 56 is not shown for the sake of simplicity.

What is claimed is:

1. Apparatus for producing packages (23), composed of at least two cuboid part packs (25, 26) each for receiving a group (21, 22) of cigarette packs (20), from a single one-piece blank (24), said apparatus comprising:

a) a folding turret (42) which has an axis for rotation thereabout, and which has a plurality of radially directed pockets (48), each for receiving a package (23) from an open radially outer side;

b) wherein each pocket (48) has a central stationary folding blade (51) and lateral movable pocket walls (53, 54), c) wherein said folding blade (51) extends in a radially and axially directed plane relative to said folding turret, and has an axial main extension direction, d) wherein said pocket walls (53, 54) are movable between an almost parallel first position, relative to said folding blade 51, with a radially directed opening, and an open or spread second position for forming a larger said radially directed opening, and have means for pivotably mounting said pocket walls (53,54) for movement between said first and second positions, and e) means for folding said one piece blanks over said folding blades and into said pockets.

2. The apparatus according to claim 1, further comprising:

a) a feed station (43), a filling station (63) and an overhead push-out station, all of which are located at a circumference of said folding turret (42);

b) means for moving said pocket walls (53, 54), in a region of said feed station (43), between said second and first positions to receive the blank (24) and to form the part packs (25) open on the radially outer side; and c) means for moving said pocket walls (53, 54) slightly together relative to said spread-open second position in a region of the filling station (63), but not parallel to one another or to the folding blade (51), so that the groups (21, 22) are insertable into the part packs (25, 26), and d) wherein said pocket walls (53, 54) are directed almost parallel to one another or to the folding blade (51) in a region of said push-out station (78).

3. The apparatus according to claim 1, further comprising pivot bearings (55) for mounting said pocket walls (53, 54).

4. Apparatus according to claim 2, further comprising a folding unit (56), assigned to said feed station (43) for introducing the blank (24) into the pocket (48) so that the part packs (25, 26) open on the outside are folded.

5. Apparatus according to claim 4, wherein said folding unit (56) has two pivotably mounted folding wings (57, 58) which, from an extended position, by pivoting relative to one another, from a common plane perpendicular to the radial direction, and simultaneously moving into the pocket (48), operate to fold the blank (24) on both sides of the folding blade (51), and wherein inner walls (27), longitudinal side walls (29) and outer walls (28) of the blank are foldable by folding edges (59) of the foldings wings (57, 58), said folding edges having folding cants (61, 62).

6. Apparatus according to claim 5, wherein, during the folding operation, the folding wings (57, 58) slide along with a folding edge (59) on an inside of the pocket walls (53, 54) moved into the spread second position, thereby taking up the blank (24), and wherein, after termination of the folding operation, the folding wings (57, 58) extend on both sides of, and parallel to, the folding blade (51), and the pocket walls (53, 54) are moved into the parallel first position corresponding to a dimension of the package (23).

7. Apparatus according to claim 2, further comprising, in a region of the filling station (63), means for feeding the groups (21, 22) of cigarette packs (20) superposed and in a horizontal push-in plane to a pocket (48) having the prefolded packages (23), the groups (21, 22) being movable apart from one another in the direction of movement of the folding turret (42), in such a way that they assume a distance from one another corresponding to distances between the part packs (25, 26) so that they are pushable into the part packs.

8. Apparatus according to claim 7, wherein said feeding means feeds the groups (21, 22) to the pocket (48) in a manner offset in the radial direction of the folding turret (42), in such a way that a group (21), which is upper or second in the direction of movement of the folding turret (42), is moved nearer to the folding turret (42), so that the upper or second group (21) is liftable off the group (22) beneath it by the folding blade (51) of the pocket (48) as a result of the rotation of the folding turret (42).

9. Apparatus according to claim 2, further comprising: means for feeding the cigarette packs (20) to the filling station (63) on a platform (66) in rows (64, 65) of two superposed cigarette packs (20), the platform (66) being arranged offset relative to a push-in plane into the pockets (48); and an intermediate conveyor (71) for transporting the groups (21, 22) from the plane of the platform (66) to the push-in plane, said intermediate conveyor (71) being movable up and down.

10. Apparatus according to claim 2, further comprising a pack lifter (83) for, in a region of the overhead push-out station (78) of the folding turret (42), moving the part packs (25, 26) separated from one another out of the pocket (48) and feeding them to a discharge conveyor track (79), said pack lifter (83) being movable in the radial direction.

11. Apparatus according to claim 10, wherein the pocket walls (53, 54) and the folding blade (51) are made comb-like, in such a way that the folding blade (51) forms comb fingers (52) arranged at a distance from one another and the pocket walls (53, 54) form pocket webs (81) arranged at equal distances from one another, and wherein the pack lifter (83) is made comb-like at least in a region confronting the pocket (48) in the region of the push-out station (78), to form sliding fingers (82) which, as a result of rotation of the folding turret (42) during feeding of the pocket (48) to the push-out station (78), come into a position underneath the package (23) between the comb fingers (52) and pocket webs (81).

12. Apparatus according to claim 11, wherein the folding turret (42) has two turret discs (49) which are arranged at a distance from one another and which are connected to one another in the region of the pockets (48) by means of crossmembers (50) directed axis-parallel, there being formed on the crossmembers (50), in the region of the comb fingers (52) and of the pocket webs (81), a pocket bottom (85) which guarantees, in the region between the comb fingers (52) and pocket webs (81), a gap relative to the crossmember (50) for the entry of the sliding fingers (82).

13. Apparatus according to claim 11, wherein the comb fingers (52) have dimensions larger in the radial direction than the inner walls (27) of the package (23), and wherein the outer edge of the comb fingers (52) is made sharp-edged or knife-like, in such a way that, when the groups (21, 22) are being pushed into the part packs (25, 26), a pull is exerted on the inner walls (27) and leads to the severing of an edge connection (32), joining the inner walls or of residual connections (34).

14. Apparatus according to claim 2, wherein in the region of the push-out station (78) there is disposed a severing knife (86) for severing an edge connection (32) between the part packs or residual connections (34), said severing knife (86) being movable along in the longitudinal direction of the part packs (25, 26) and therebetween, thereby severing the edge connection (32) or the residual connections (34).

15. An apparatus for producing packages (23), composed of at least two cuboid part packs (25, 26) each for receiving a group (21, 22) of cigarette packs (20), from a single one-piece blank (24), said apparatus comprising:

a) a folding turret (42) which has an axis for rotation thereabout, and which has a plurality of radially directed pockets (48), each for receiving two part packs (25, 26) from an open radially outer side;

b) wherein each said pockets has a middle pocket-separating wall (51) and lateral pocket walls (53, 54), and c) wherein said pocket-separating wall (51) extends in an axially and radially directed plane relative to said folding turret;

d) means for introducing said one piece blanks into said pockets to receive said groups; and e) means for simultaneously feeding two successive groups (21, 22) offset to one another to the pockets in the rotational, circumferential direction of said folding turret in such a manner that a respective second group (21), in the direction of rotation of said folding turret, is moved closer to said folding turret, so a respective second group (21) is lifted off from the respective first group (22) in the direction of rotation of said folding turret by said pocket-separating wall (51) as a result of the rotation of the folding turret (42).

16. The apparatus according to claim 15, a) wherein said feeding means feeds the groups (21, 22) to the pockets (48) in a manner offset in the radial direction of said folding turret (42), and comprises a pair of ram members (72, 73) which adjoin one another in the circumferential direction of said folding turret (42) and which are arranged adjoining said folding turret (42); and further comprising b) means for moving said ram members (72, 73), in the radial direction of the folding turret (42), relative to one another and against the groups (21, 22), and taking said groups (21, 22) along.

17. The apparatus according to claim 16, a) wherein said ram members (72, 73) are arranged in the radial direction of the folding turret 42 at a distance from the circumference of the folding turret and from the pockets (48); and further comprising:

b) a mouthpiece (77), located between said ram members (72, 73) and the circumference of said folding turret (42), for transferring the groups (21, 22) into a respective adjoining pocket (42); and c) a bridge (76) which is arranged between the ram members (72, 73) and the mouthpiece (77) and on which the groups (21, 22) come to rest in a superposed position.

* * * * *